US005533566A

United States Patent [19]

Fineblum

[11] Patent Number: 5,533,566

[45] Date of Patent: Jul. 9, 1996

[54] CONSTANT VOLUME REGENERATIVE HEAT EXCHANGER

[76] Inventor: Solomon S. Fineblum, 268 Greystone La., Rochester, N.Y. 14618

[21] Appl. No.: 950,861

[22] Filed: Sep. 30, 1992

Related U.S. Application Data

[63] Continuation-in-part of Ser. No. 838,502, Feb. 18, 1992, abandoned.

[51] Int. Cl.[6] ..... F01C 21/04

[52] U.S. Cl. ..... 165/1; 165/47; 165/122; 417/207; 418/83; 418/259; 418/266

[58] Field of Search ..... 417/207; 418/83, 418/259, 266; 165/122, 1, 47

[56] References Cited

U.S. PATENT DOCUMENTS

| | | | |
|---|---|---|---|
| 1,590,964 | 6/1926 | Street | 418/83 |
| 3,098,602 | 7/1963 | Torluemke | 417/207 |
| 3,565,551 | 2/1971 | Hobson | 417/207 |
| 4,640,667 | 2/1987 | Trepp | 417/207 |

FOREIGN PATENT DOCUMENTS

| | | | |
|---|---|---|---|
| 688172 | 5/1930 | France | 418/83 |
| 608167 | 1/1935 | Germany | 418/83 |

*Primary Examiner*—John K. Ford

[57] ABSTRACT

The purpose of regenerative heat exchangers is to transfer the heat from one step or process of a cycle or system to an earlier step or process in the cycle or system such that the transferred heat is usefully absorbed rather than being discarded. The gas being heated is moved in a counter flow relative to the hotter fluid while being trapped between moving partitions (vanes) such that the gas so trapped is heated with a fixed volume with an increase in pressure as well as temperature. In some embodiments, the hotter as well as the cooler fluid is moved while trapped between moving partitions (vanes) so, as the cooler fluid being heated is thermally pressurized, the hotter fluid being cooled with a fixed volume is thermally pressurized. Materials and design details are selected to enhance the heat transfer between the two streams. The heat transfer at constant volume and thermal pressurization and depressurization will improve the energy efficiency of many processes that require a pressure increase/decrease along with heating/cooling. This invention accomplishes compression/decompression and heating/cooling with only one device rather than with two devices.

3 Claims, 14 Drawing Sheets

CONSTANT VOLUME REGENERATIVE HEAT EXCHANGER

This application is a continuation-in-part of application Ser. No. 838,502 filed Feb. 18, 1992, now abandoned.

BACKGROUND

1. Field of Invention

This invention relates to heat exchangers and constant volume regenerative heat exchangers which are capable of constant flow, in particular.

2. Prior Art

Presently available regenerative heat exchangers typically operate in a counter-flow, approximately constant pressure manner. Approximately constant pressure heating results in an increase in the specific volume which is proportional to the increase of the absolute temperature. The heat exchanger and the downstream vessels must therefor be enlarged to accommodate the increased specific volume. In some applications, such as in Stirling cycle systems, the required constant volume heat transfer is accomplished in a stop-start manner with a heat absorbing matrix in the path between the hotter and cooler chambers. As a result, the rate of heat exchange is very slow as is the rate of power generation. Many processes are enhanced in efficiency if performed at a higher pressure. Current heat exchangers typically add to the temperature of the heated gas but not to the pressure. There are may situations where a gas is required to be at a state of high pressure as well as high temperature. This is now accomplished by separate compression and heating processes. The present invention accomplishes this in one step; by heat exchange at constant specific volume and steady flow such that the heated gas increases in pressure as well as temperature. This is accomplished with only one device rather than two.

Feldkamp, Gr 608167, 17 Jan. 1935, teaches a hot air rotary piston engine with an outer passage surrounding the heated gas. In order to act as an engine the volumes between the vanes must expand as they do. "In front of the exhaust the ring-like space is, from point F onwards, bulged out so that at this point the vanes C can further jut out of the rotor. From this point on the working spaces are extended."

In contrast our heat exchanger is characteristically and essentially a constant volume heat exchanger instead of an expanding space engine.

Thus, in form (constant instead of expanding) and function (heat exchanger instead of engine) our constant volume heat exchanger is neither anticipated nor suggested by Feldkamp.

Schmied, Fr 688,172, teaches "A system for the cooling of the exterior cylinder or stator of a rotary piston compressor." The volumes trapped between the sliding vanes vary with position as necessary and typical of rotary compressors. Our constant volume heat exchanger is neither anticipated nor suggested by any obvious similarity by Schmied's variable volume compressor.

OBJECTS OF THE INVENTION

Accordingly, several objects and advantages of my invention are:

The heating of fluids at constant volume.

The heating of fluids at constant volume and constant flow.

The thermal pressurization of the fluid being heated.

The cooling of fluids at constant volume and constant flow.

Thermal depressurization of the fluids being cooled.

Use of the torque due to the negative pressure gradient in one stream to overcome some of the torque due to the positive pressure gradient in the other stream.

Further objects and advantages of the invention will become apparent from a consideration of the ensuring description and drawings.

DETAILED DESCRIPTION OF PREFERRED EMBODIMENTS

Figure 1:
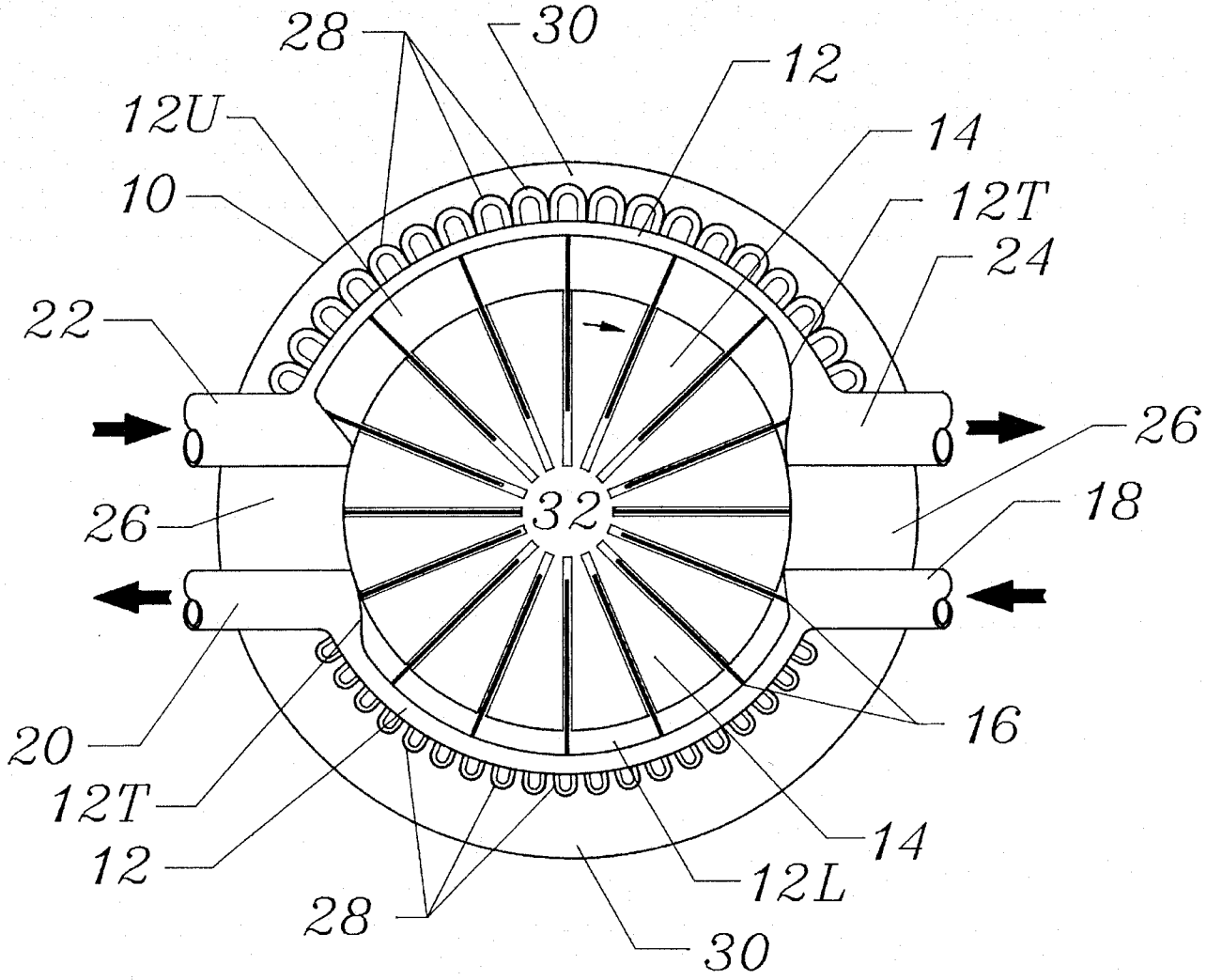
FIG. 1 is an interior view of a constant volume regenerative heat exchanger.

FIG. 1 shows an embodiment of a constant volume, constant flow, counter flow regenerative heat exchanger 10 according to the invention. Heat exchanger 10 comprises a cylindrically-shaped enclosure 12 rotatably mounted within which is a rotatable slotted rotor 14 which supports radially movable partitions or vanes 16 that can slide radially outwardly and inwardly within the slots of rotor 14. The vanes 16 also are free to move with the rotatable slotted rotor 14 in a rotational manner about the axis of rotor 14 as shown in FIG. 3.

The interior walls of the enclosure 12 form two separate semi-circular channels 12L and 12U. One channel 12L (the lower as viewed by the reader) has the interior wall of the enclosure 12 a fixed, relatively short radial distance from the slotted rotor 14. The other, upper channel 12U, is a larger channel with the interior wall of the enclosure 12 a fixed and relatively greater distance from the outer periphery of slotted rotor 14.

During operation moving vane-like partitions 16 are moved radially outward so that the ends thereof fit closely along interior side walls of enclosure 12 during their travel through both the upper and lower channels 12U and 12L. This can be achieved by the effect of centrifugal forces acting on the vane 16 or springs or both acting in conjunction with the effect of the sidewalls of the channel on the ends of the vanes 16. As rotor 14 rotates at a predetermined rotational velocity, the radially movable vanes 16 move inwardly or outwardly, to maintain contact between the ends of the vanes land the enclosing side walls of the respective upper and lower channels 12U and 12L thereby forming relatively gas-tight chambers between the vanes 16 which are of constant volume.

An inlet conduit 18 directs gas from a source of cooler gas to be heated, not shown here, into the lower, smaller cooler channel 12L. An outlet conduit 20 directs the gas which has been heated at constant volume and thermally pressurized from lower, smaller channel 12L toward a high pressure side of a using system, not shown. A second inlet conduit 22 directs gas from a source higher temperature gas, now shown, into an input of upper, larger, warmer channel 12U. A second outlet 24 directs cooled and thermally depressurized gas at lower pressure from the output of the upper channel 12U towards the cooler side of a using system, not shown. These conduits 18, 20, 22 and 24 are insulated.

Inter channel seal means 26 are provided which project radially inwardly from opposite sides of enclosure 12 so as to fit closely with uniformly slotted rotor 14 and divide the enclosure into the upper and lower channels 12U and 12L. The interior sidewalls of enclosure 12 as well as the inner ends 18, 20, 22 and 24 have their innermost faces contoured to permit smooth transitions of moving vane-like partitions 16 from a radially outward extended position while moving within upper and lower channels 12U and 12L to a retracted position of the radially moving vanes 16 at the inter channel seals 26. In particular, the sidewalls of enclosure 12 defining the inter channel seal means 26 are gradually tapered as shown at 12T in FIG. 1 so as to facilitate the radially in and out movement of the ends of the vanes 16 during operation. This kind of end vane seal has long been used successfully in the compressor industry as reported in prior publications such a Marks' For Mechanical Engineers 8th Edition, Chapter 14–44 on high vacuum pumps published by McGraw Hill under L.O.C. No. 04072899 dated 1978.

Aligned heat transfer augmentation tubes 28 are provided which extend between cooler lower channel 12L and warmer upper channel 12U. Tubes 28 are filled with heat conducting fluid, preferably with a high coefficient of thermal expansion for improved heat augmentation. Heat pipes could be utilized for aligned heat transfer augmentation in place of tubes 28, if desired. The entire heat exchanger 10 is covered by thermal insulation 30. A drive shaft 32 drives slotted rotor 14, and required bearings to support drive shaft 32 and seals to seal openings around the drive shaft are not shown. These components are so formed and arranged that:

Cooler lower channel 12L has a uniform, relatively short radial dimension from slotted rotor 14 to the inside sidewalls of channel 12L and moving vanes 16 extend into lower channel 12L only a relatively short distance from the outer edge of slotted rotor 14. Warmer upper channel 12U permits moving vanes 16 to extend a uniform, relatively greater distance from the outer edge of slotted rotor 14. This permits vanes 16 to extend out from slotted rotor 14 a relatively greater distance and to form a quantitative larger channel 12U. This larger channel accommodates hotter gas from hot gas intake conduit 22. Aligned heat transfer augmentation tubes 28 are so oriented that one extends from the inlet of cooler lower channel 12L to outlet of warmer upper channel 12U. Another tube 28 extends from inlet of upper warmer channel 12U to outlet of cooler channel 12L. Other heat transfer augmentation tubes 28 are placed uniformly around the enclosure 12 between the cooler channel 12L and warmer channel 12U.

As a result of the above-described construction, the warmest portions of one channel 20 are in heat transfer contact with warmest portion 22 of the other channel and the coolest portions 18 of the first-mentioned channel are in heat transfer contact with coolest portion 24 of the other channel. Temperature differences between warmer gas and cooler gas is thereby minimized throughout. Gas within the cooler upper channel 12U is thermally pressurized at constant volume by gain of heat through aligned heat transfer augmentation tubes 28 from warmer gas within warmer lower channel 12L. Consequently, the two gas streams are respectively thermally pressurized and thermally depressurized with regenerative heat transfer at constant volume and constant flow.

Figure 2A:
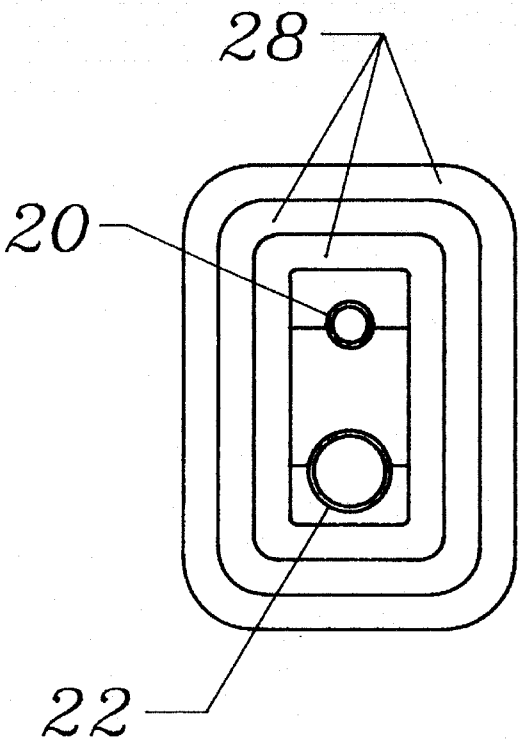
FIGS. 2 and 2A show two exterior views of a constant volume heat exchanger with insulation removed for clarity.
Figure 2:
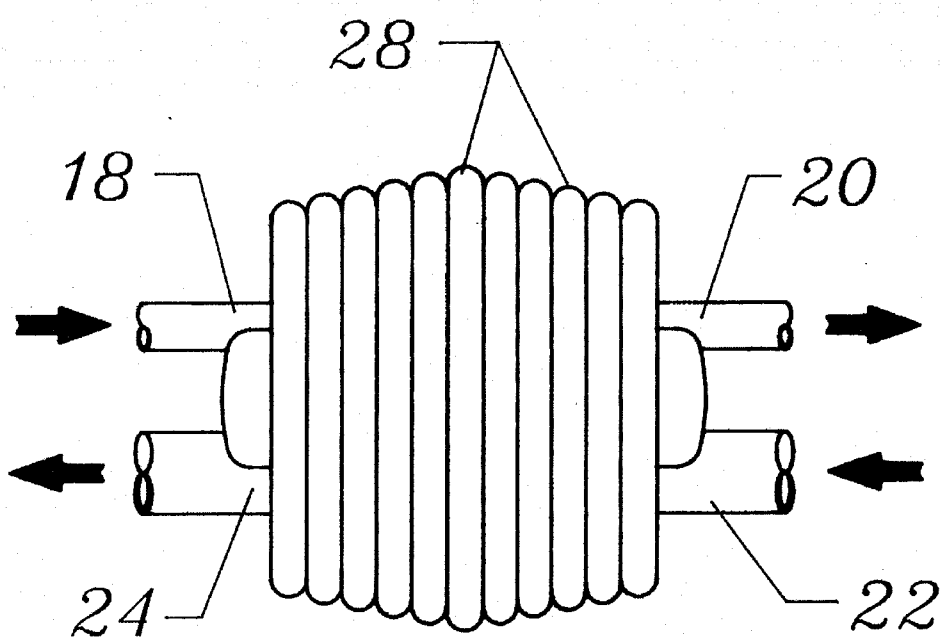

FIG. 2 shows respective, exterior side and end views of the constant flow, constant volume regenerative heat exchanger shown and described with relation to FIG. 1. In these figures exterior insulation 30 and insulation covers usually provided are removed to more clearly show location and arrangement of aligned heat transfer augmentation tubes 28.

Figure 3B:
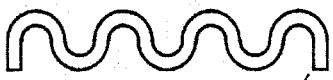
FIGS. 3 and 3A through 3D show different vane details of construction to achieve heat transfer augmentation.
Figure 3A:
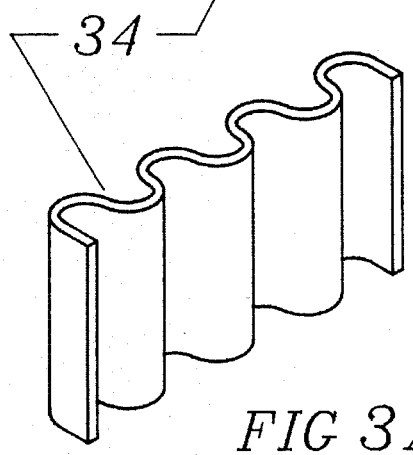
Figure 3:
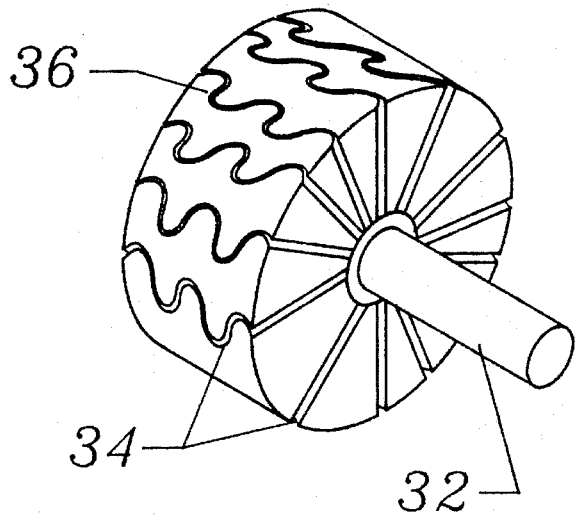

FIGS. 3, 3A and 3B show one technique for stimulating improved rate of heat transfer in constant flow, constant volume regenerative heat exchanger of the type described above with relation to FIGS. 1, 2 and 2A. FIG. 3 is a perspective, overall view of a slotted rotor 36 subassembly having convoluted vane-like partitions 34.

FIG. 3A illustrates a convoluted vane 34 that acts as one of a number of moving vane partitions in a slotted rotor 36 with a matching convoluted slots 35 shown in FIG. 3B. The convoluted design of the rotor and vane subassembly result in increased heat transfer contact of the surrounding gas within enclosure 12 with the surfaces and ends of the convoluted vanes. In addition structural stiffness of the vanes is enhanced.

Figure 3C:
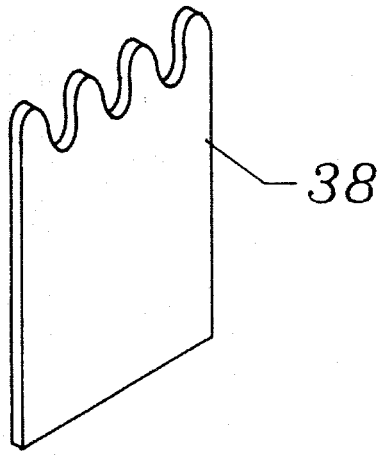
Figure 3D:
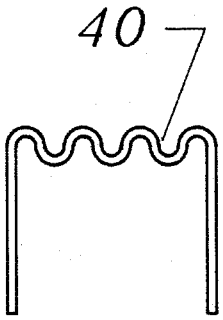

FIGS. 3C and 3D illustrate different forms of moving vane-like partition using an indented vane 38 shown in FIG. 3C that slides along a complementary-shaped heat exchanger sidewall enclosure 40 with complementary conforming convolutions.

Figure 4:
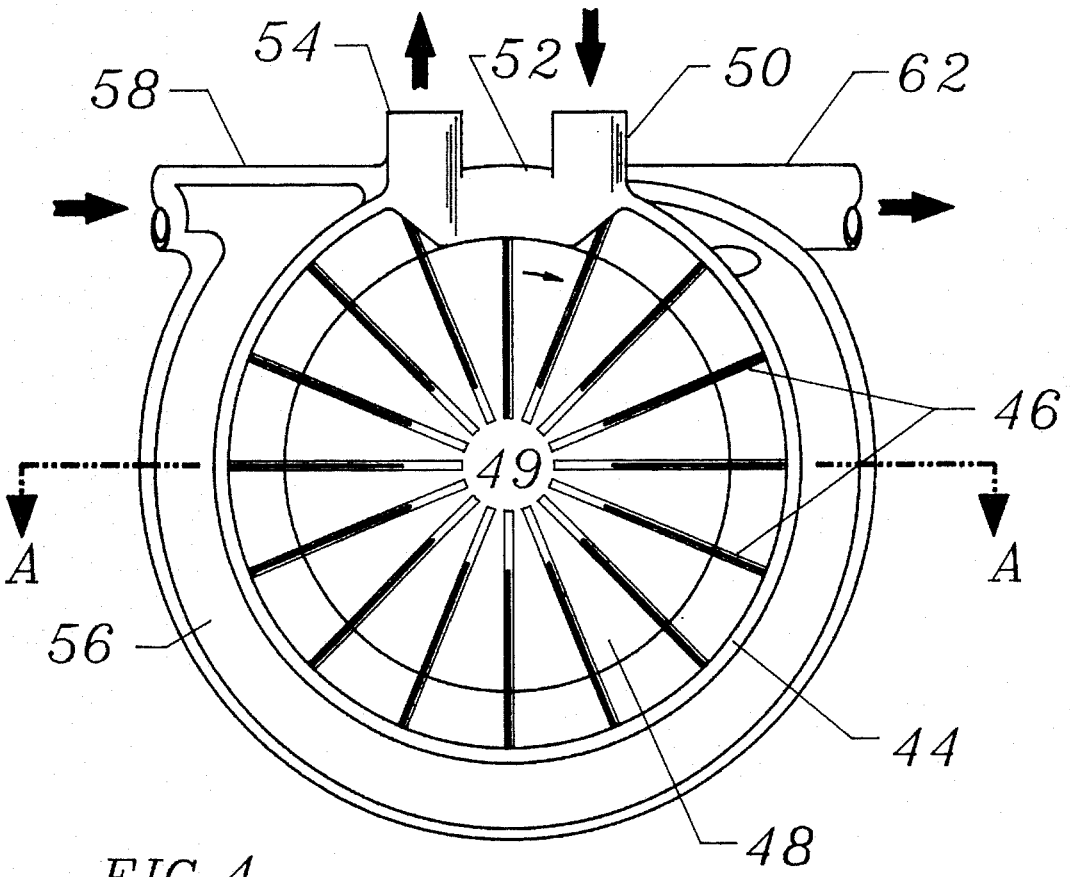
FIG. 4 is a cross-sectional view of another embodiment of the constant volume heat exchanger with only one fluid at constant volume.
Figure 4A:
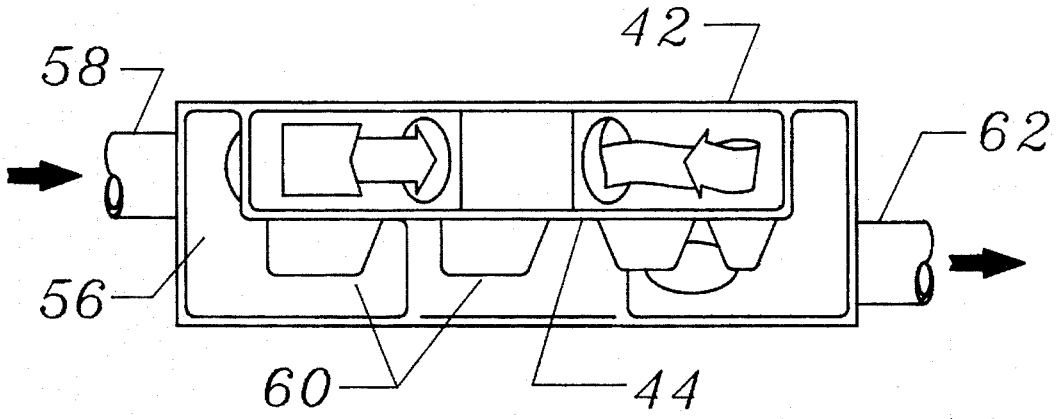
FIG. 4A is a sectional view of the heat exchanger shown in FIG. 4 taken through plane A—A.

FIGS. 4 and 4A are respective cross-sectional and sectional views of a different embodiment of a constant volume, regenerative heat exchanger 42 which employs a stacked, coaxial over and under design. In FIG. 4 an upper, inner, circular enclosure 44 forms a channel around radially sliding vanes 46 which slide in and out within slots of slotted rotor 48. Outer peripheral edges of sliding vanes slide in close fit within walls of enclosure 44. A drive shaft 49 rotatably drives slotted rotor 48.

An inlet conduit 50 for gas to be heated is formed on one side of an inter passage seal 52 in enclosure 44 and a thermally pressurized gas outlet 54 is formed on the other side of inter passage seal 52. Inter passage seal 52 divides the cooler low pressure upstream end 50 from the high pressure down stream end 54 of the constant volume channel defined by enclosure 44 in which vanes 46 rotate. Inter passage seal 52 is formed so as to force the ends of rotatable moving vanes 46 to slidably withdraw down into the periphery of rotor 48 in its travel between higher pressure outlet 54 and cooler, lower pressure inlet 50. This acts to form a seal between inlet 50 and outlet 54 to thereby minimize leakage of higher pressure warm gas to the lower pressure cooler inlet gas to be heated.

Gas entering through inlet 50 is driven between the rotatable vanes 46 which are driven by slotted rotor 48 that in turn is driven by drive shaft 49. Gas trapped in the constant volume spaces between rotating vaines 46 is heated by hot fluid passing through a lower circular, outer enclosure channel 56 that is stacked (juxtaposed) immediately under the upper enclosure 44 and is in heat transfer relationship with enclosure 44. The direction of rotation of vanes 46 and gas trapped within the constant volume space between vanes 46 is counter to the flow direction of hot gas flowing in hot fluid, lower channel 56. Heat transfer is stimulated by a set of fins 60 on the upper surface of enclosure 44 that protrude into hot fluid channel 56 as best seen in FIG. 4A. Hot fluid in hot fluid channel 56 after cooling exits through outlet conduit 62.

FIG. 4A is a sectional view of the constant volume, regenerative, over and under heat exchanger taken through plane A—A of FIG. 4. Slotted rotor 48 and moving vane-like partitions 46 are omitted in FIG. 4A for clarity. Insulation around heat exchanger and a drive shaft is also omitted from FIG. 4A for clarity. The inlet gas 50 to be heated is regeneratively heated at constant volume in spaces between vanes 46 and thereby thermally pressurized and discharged through outlet 54.

In the preceeding description of FIGS. 4 and 4A it has been assumed that the heat exchanger is to be used in a heating system. The invention is not restricted to just heating applications, but also can be used for cooling as in air conditioning and cooling systems.

If desired, the apparatus of FIGS. 4 and 4A, for example, could be used for cooling purposes simply by supplying a cold, lower temperature coolant fluid to the inlet 58 and withdrawing the spent coolant fluid from outlet 62. Concurrently, the fluid medium to be cooled is supplied through the intake conduit 50 to the upper channel 44 where it will be cooled and depressurized within the spaces between vanes 46 by the coolant fluid supplied through inlet 58.

Figure 5:
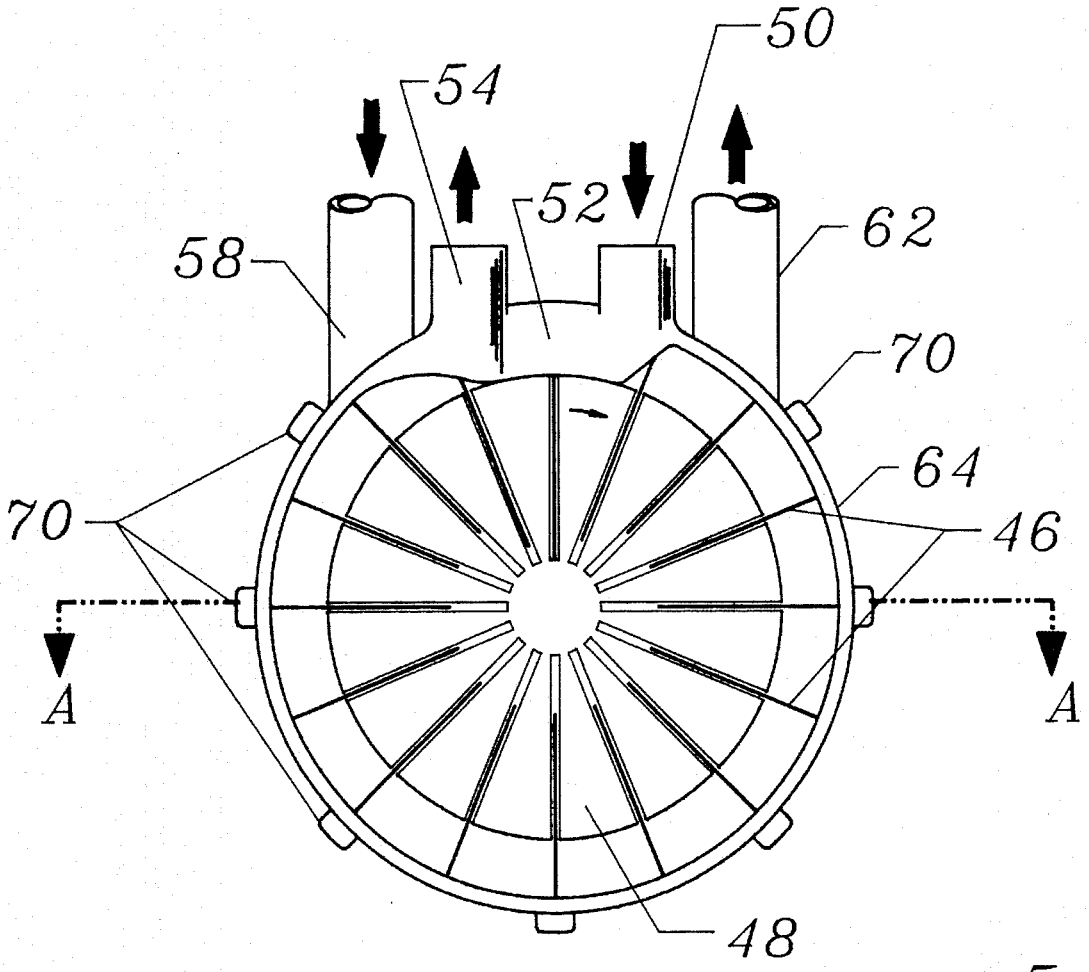
FIG. 5 is a partially broken-away cross sectional view of a constant volume heat exchanger with heat pipe heat transfer augmentation.
Figure 5A:
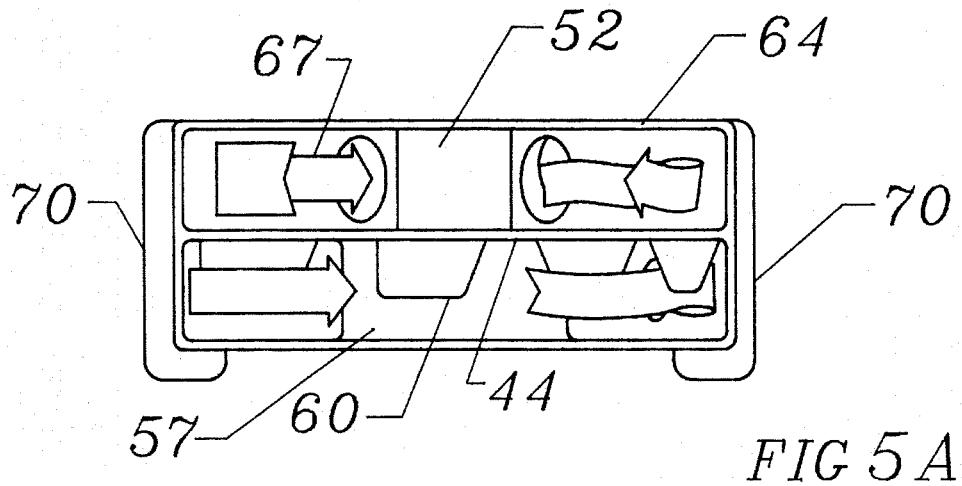
FIG. 5A is a sectional view of the heat exchanger shown in FIG. 5.

FIG. 5 and FIG. 5A show a cross sectional view of another over and under embodiment of a constant volume, regenerative heat exchanger that is similar to FIG. 4 and includes a channel enclosure 64 within which radially slidable vanes 46 are rotated by a slotted rotor 48. In addition, the embodiment of FIG. 5 further includes a plurality of heat pipes 70. As a result, heat transfer between hot fluid supplied through hot fluid channel 57 and cooler gas to be heated within enclosure 64 is greatly augmented by additional hot fluid supplied by heat pipes 70.

Figure 6:
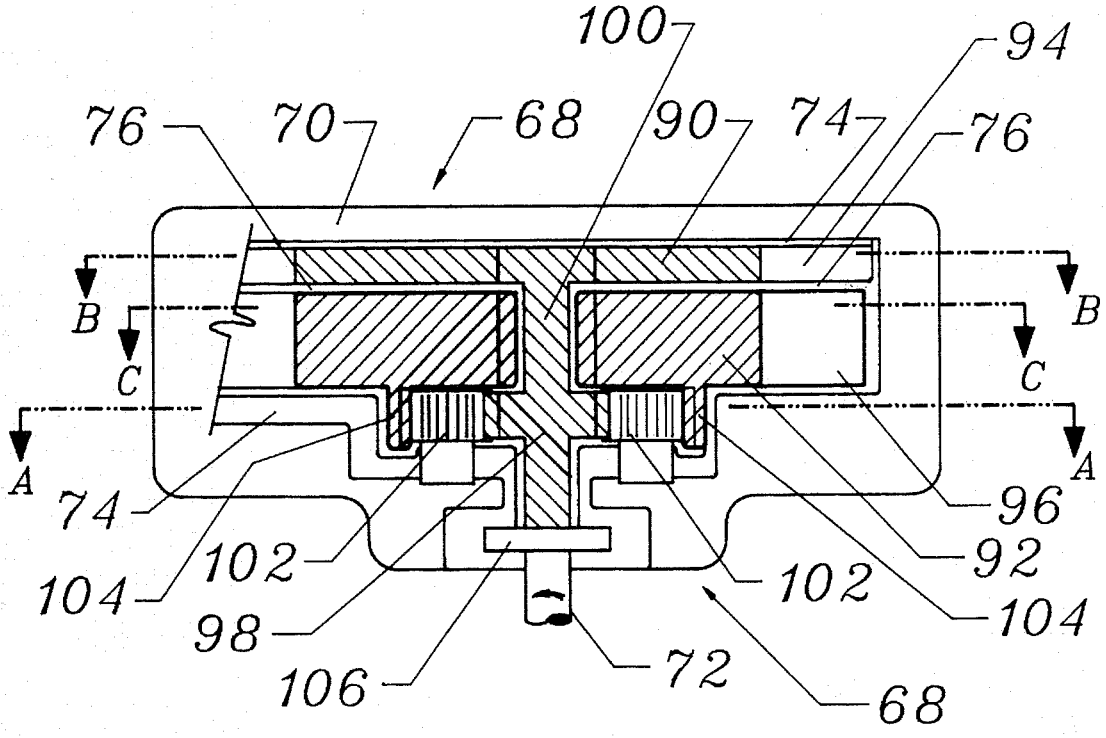
FIG. 6 is a sectional view of a regenerative heat exchanger with counter rotating sets of moving vanes.
Figure 6A:
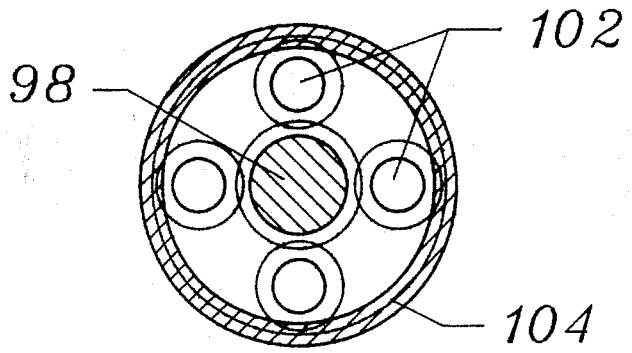
FIG. 6A is a cross-sectional view of the heat exchanger shown in FIG. 6 taken through plane A—A.
Figure 6B:
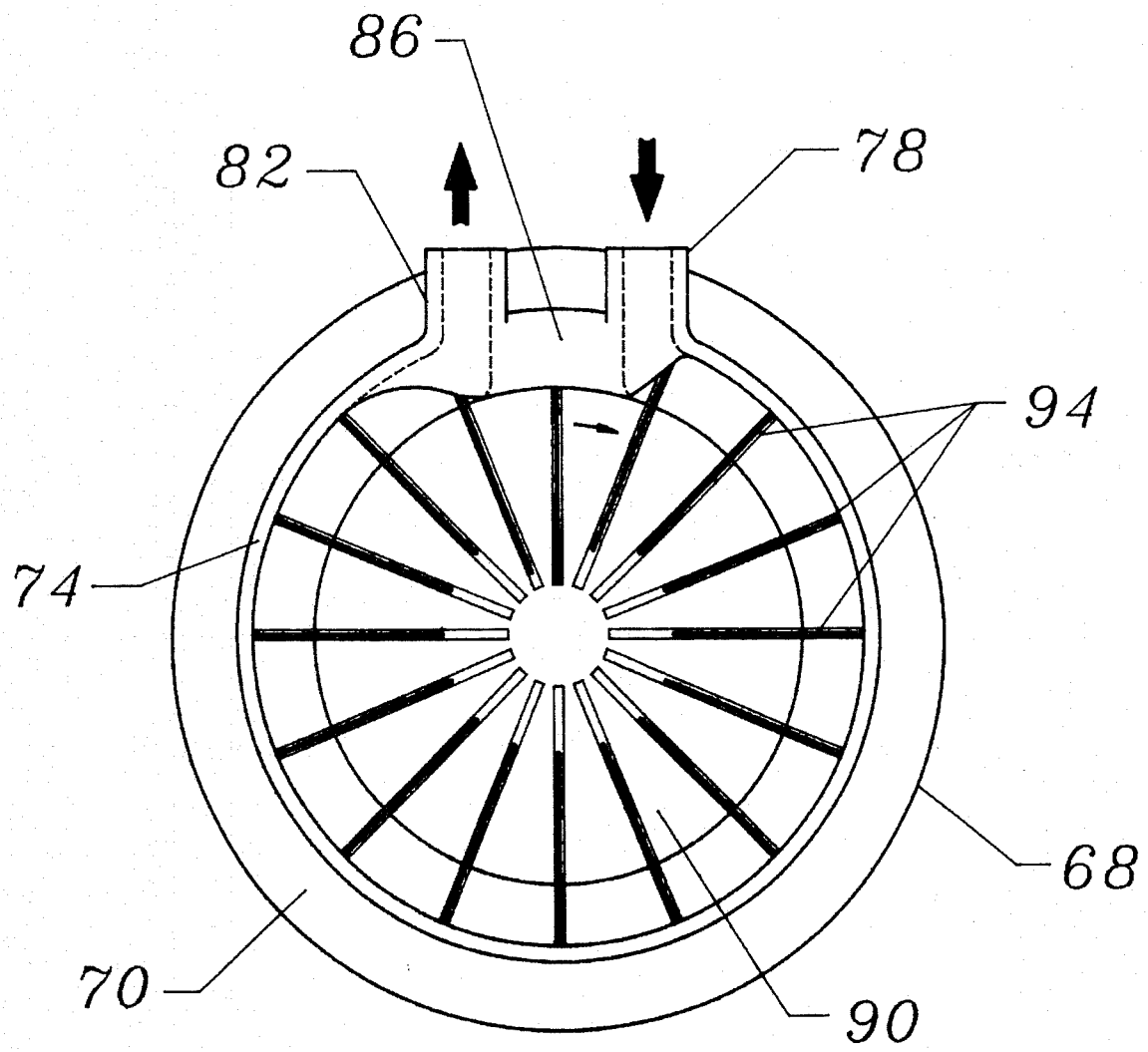
FIG. 6B is a cross-sectional view taken through plane B—B of FIG. 6.
Figure 6C:
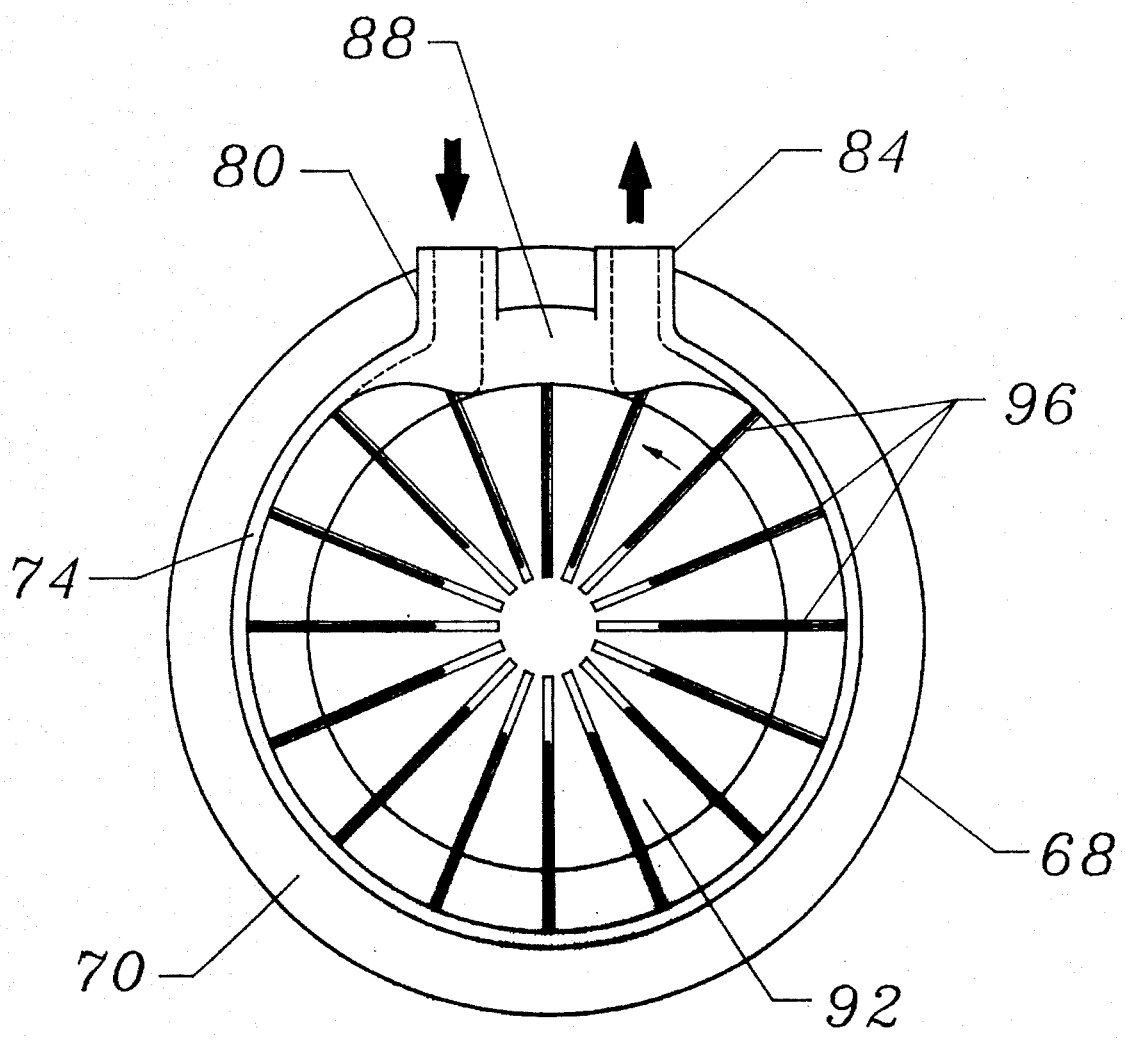
FIG. 6C is a cross-sectional view taken through plane C—C of FIG. 6.

FIGS. 6 and 6A–6C show a partially cutaway side view and cross sectional views taken through planes A, B and C, respectively, of another embodiment of a constant volume, regenerative, over and under heat exchanger 68. Heat exchanger 68 has an insulating cover 70, a drive shaft 72, and an enclosure 74. Secured within enclosure 74 is a separator 76 which divides enclosure 74 into two separate, upper and lower, enclosed channels. Separator 76 is relatively thin and thermally conductive so that the two channels are juxtaposed one over the other and in close heat transfer relationship. An inlet 78 and an outlet 82 are provided to the upper channel as shown in FIG. 6B and an inlet 80 and an outlet 84 are provided to the lower channel as best shown in FIG. 6C.

Inter channel seals 86 shown in FIG. 6B and 88 shown in FIG. 6C function to isolate the inlet from the outlet of each channel. Within both channels of enclosure 74 are a slotted rotor 90 in the upper channel and rotor 92 in the lower channel. Sets of moving vane-like partitions 94 are slidably supported in upper slotted rotor 90 in a radially movable manner, and vane-like partitions 96 are slidably supported in lower slotted rotor 92. The two chambers or channels within enclosure 74 are so shaped as to form cylindrically-shaped channels around slotted rotors 90 and 92 with the sidewalls of the channels shaped to just touch the peripheral ends of the rotatable vanes supported in the respective rotors so as to conform to and fit closely to the sidewalls of the channels.

The upper slotted rotor 90 is connected to a gear 98 by a shaft 100 as shown in FIG. 6. As best seen in conjunction with FIG. 6A, a set of idler gears 102 coact with a geared extension 104 formed on the inner surface of a lower extension 104 on second slotted rotor 92 and are in the same plane as gear 98. A seal 106 fits around drive shaft 72 so as to prevent leakage of lubricating oil out of the gear assembly.

As best shown in FIG. 6B, inter channel seal 86 in the upper channel is placed between inlet 78 and outlet 82 and inter channel seal 88 in the lower chamber shown in FIG. 6C is placed between inlet 80 and outlet 84. It should be further noted that inlet 78 in the upper channel of enclosure 74 is juxtaposed immediately above outlet 84 in the lower chamber and the two are in good heat exchange relationship. Further, the lower edge of the slidably moving and rotating vanes 94 slide upon the upper surface of separator 76 and the upper edges of rotatable and slidably moving vanes 96 slide along the lower surface of separator 76.

The upper channel in enclosure 74 above separator 76 contains slotted rotor 90 and radially moving and rotating vanes 94. The lower channel below separator 76 contains slotted rotor 92 and the inner end portions of radially moving and rotating vanes 96. Moving vanes 94 and 96 fit closely to the inside surfaces of the sidewalls of the channels formed around slotted rotors 90 and 92 within enclosure 74. The sidewalls of the channels around slotted rotors 90 and 92 are designed to be a constant distance from the peripheries of slotted rotors 90 and 92. External gear 98 which is structurally integral with slotted rotor 90 is placed within internal gear 104 which is structurally integral with slotted rotor 92. Idler gears 102 fit between external gear 98 and internal gear 104.

As a result of the above structural arrangement, upon drive shaft 72, external gear 98 and slotted rotor 90 being rotated in response to rotation of drive shaft 72, idlers 102 drive internal gear 104, slotted rotor 92 and vanes 96 in the opposite direction of rotation from slotted rotor 90 and vanes 94. With the apparatus thus conditioned, when relatively cool gas to be heated enters the upper channel formed around slotted rotor 90 through inlet 78, the cooler gas is trapped in constant volume spaces between the moving vanes 94 and driven in one direction. Hot gases supplied through intake conduit 80 are trapped in the constant volume spaces between vanes 96 of the lower channel and are driven in the opposite direction. As a result, the gases in the respective upper and lower chambers are moved in counterflow directions and are regeneratively heated or cooled at constant volume and constant flow.

FIG. 6B is a cross sectional view through plane B—B of FIG. 6 and showing the form and contents of the upper channel of enclosure 74. Inter channel seal 86 is so shaped as to force the radially movable and rotating vanes 94 deeper into the slots of slotted rotor 90 upon the peripheral end of the vanes coming into alignment with and engaging inter channel seal 86. The hotter and higher pressure gas in the vicinity of outlet 82 is thereby prevented from leaking back into entrance region near inlet 78. Moving vanes 94 are free to move radially in or out within the slots of slotted rotor 90 and fit closely within the sidewalls of the upper channel formed around slotted rotor 90.

FIG. 6C is a cross-sectional view taken through plane C—C of FIG. 6. From FIG. 6C it will be seen that an inter passage seal 88 separates the inlet 80 to the lower channel in enclosure 74 from the outlet 84 of the channel thereby preventing intermixture of the exhausted supply of gas after cooling with the hotter inlet supply gas at 80. Also it should be noted that inlet 80 for the hot supply gas to the lower channel is juxtaposed immediately below and in heat transfer relationship with heated gas outlet 82 from the upper channel of enclosure 74. Correspondingly, the outlet 84 of the reduced temperature, exhaust, hot supply gas from the lower channel of enclosure 74 is juxtaposed to and immediately below the inlet 78 to the upper channel of enclosure 74 for the gas to be heated. Consequently, it will be seen that temperature difference between the upper and lower channels are everywhere minimized whereby the cooler gas is heated at constant volume between the vanes of the upper channel and thus becomes thermally pressurized by heat gain and the hot supply gas is cooled at fixed volume and thermally depressurized between the vanes of the lower channel whereby regenerative heat transfer and constant volume thermal pressurization and thermal depressurization are achieved with optimum economy using the heat exchanger system of FIG. 6 according to the invention.

In operation, gas to be heated enters through inlet 78 and is moved around within the upper chamber of enclosure 74 by vanes 94 and is heated by heat being transferred through separator 76. Gas is heated while trapped within the constant volumes between moving vanes 94. The gas being regeneratively heated at constant volume is thereby thermally pressurized pursuant to the general gas law $PV/T=C$ where P is the pressure, V is the volume which remains constant, T is the temperature and C is a constant. The hot gas supplied to the lower chamber shown in FIG. 6C gives up its heat through separator 76 while being driven in a counterflow direction to gas in the upper chamber. The warmer gas is cooled while trapped between moving vanes 96 and is thereby regeneratively cooled and thermally depressurized at constant volume. The depressurization in the warmer lower chamber is maximum at the downstream end of the chamber. The resultant pressure gradient adds a positive torque to the moving vanes 96, slotted rotor 92 and the gear train consisting of gears 98, 102, and 104. This positive torque acts to drive the upper slotted rotor 90 with a consequent saving of energy.

The lower chamber, in a slight modification has the outer wall of the chamber recessed away from slotted rotor 92 shown in FIG. 6 to permit moving vanes 96 to extend further out from slotted rotor 92. As a result, the volume trapped between moving vanes will expand. This expansion will result in an increased torque being imposed on moving vanes 96 and slotted rotor 92.

In the preceeding description of FIGS. 6 and 6A–6C, it has been assumed that the heat exchanger is to be used in a heating system. The invention is not restricted to just heating applications, but also can be used for cooling as in air conditioning and cooling systems.

If desired, the apparatus of FIGS. 6 and 6A–6C, for example, could be used for cooling purposes simply by supplying a cold, lower temperature coolant fluid to the inlet 80 and withdrawing the spent coolant fluid from outlet 84. Concurrently, the fluid medium to be cooled is supplied through the intake conduit 78 to the upper channel of enclosure 74 where it will be cooled and depressurized within the spaces between vanes 94 by the coolant fluid supplied through inlet 80. In the cooling embodiment of the invention, however, because there are constant space movable vanes in both the upper and lower enclosed channels, there is an accompanying pressurization of the spent coolant fluid due to an increase in temperature at constant volume.

Figure 7:
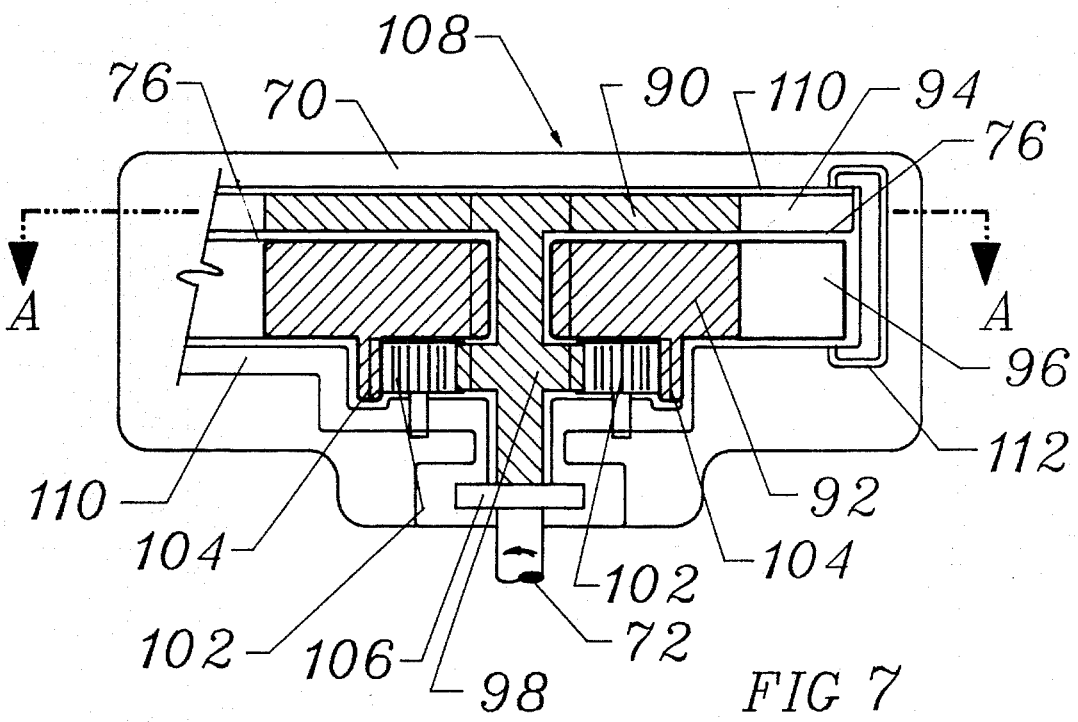
FIG. 7 shows a variation of FIG. 6 with a heat pipe addition.
Figure 7A:
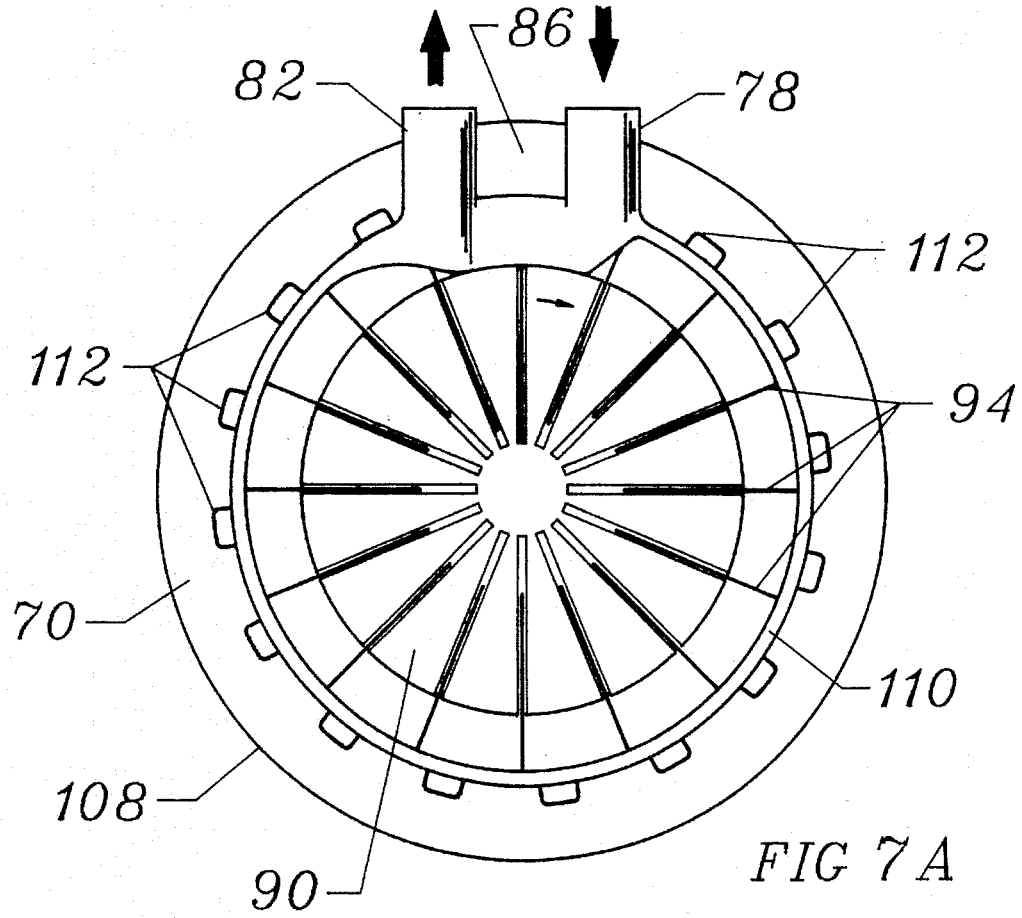
FIG. 7A is a cross-sectional view of FIGS. 7 taken through plane A—A.

FIGS. 7 and 7A show a partial, cutaway side view and a cross-sectional view, respectively, of a constant volume, regenerative heat exchanger 108 having an insulating cover 70, a drive shaft 72, an enclosure 110, a separator 76 which divides enclosure 110 into upper and lower chambers. Separator 76 is relatively thin and thermally conductive. Within the upper chamber is an inlet 78 and an outlet 82 as shown in FIG. 7A. A corresponding inlet and outlet (not shown) are provided to the lower chamber with the inlet juxtaposed under the outlet 82 of the upper chamber and the outlet juxtaposed under the inlet 78 in a manner similar to that described with relation to FIGS. 6, 6B and 6C. At this point it should be noted that the term "chambers" has been used in place of the term "channel" since the two terms are entirely synonymous. Inter chamber seals such as shown at 86 separate the inlet and outlet of each chamber. Within the upper and the lower chambers of enclosure 110 are respective slotted rotors 90 in the upper chamber and 92 in the lower chamber. There are sets of moving vane-like partitions 94 in slotted rotor 90, and 96 in slotted rotor 92. Moving partitions 94 and 96, in the form of vanes, are designed to conform to, and fit closely to the walls of the respective upper and lower chambers of enclosure 110. The upper slotted rotor 90 is integrally formed with a gear 98 and a shaft 72. A set of idler gears 102 and an internally geared extension 104 on the second slotted rotor 92 and are mounted in the same plane as gear 98. A seal 106 fits around drive shaft 72. In addition, heat pipes 112 are placed between lower and upper outer surface of enclosure 110. Heat transfer between warmer gas in the lower chamber and cooler gas in the upper chamber of enclosure 110 is greatly augmented by the heat pipes 112 and regenerative heat transfer at constant volume can be thus achieved at a greater rate.

FIG. 7A is a cross-sectional view through plane A—A of FIG. 7 showing the form and contents of the upper chamber of enclosure 110. Heat pipes 112 are placed around outer surface of enclosure 110. In operation, gas to be heated enters through inlet 78 and is moved around within the upper chamber of enclosure 110 within the constant volume spaces between the vane-like partition 94. Simultaneously, the gas is heated by heat being transferred through separator 76 as well as heat being transferred through heat pipes 112. Since the gas is heated while trapped between moving partitions 94, the gas is regeneratively heated at constant volume and thereby thermally pressurized. Gas in the lower chamber, not shown here, gives up heat through separator 76 and heat pipes 112 while being driven in a counter flow direction to gas flow in the upper chamber and is warmed thereby. This warmer gas is cooled while trapped between moving partitions 96 and is thereby regeneratively cooled and thermally depressurized. Heat pipes 112 augment heat transfer.

Figure 8:
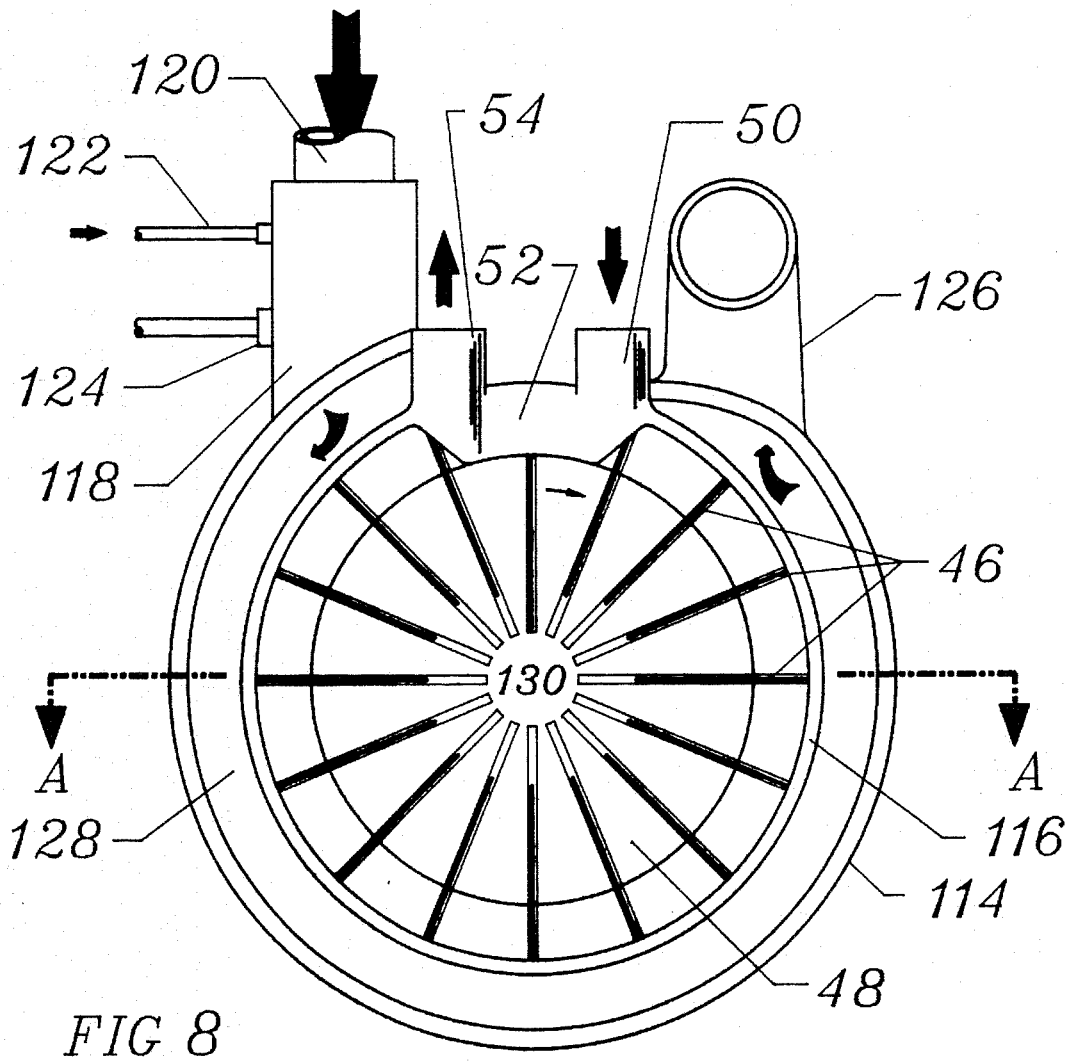
FIG. 8 is a cross-sectional view of a one channel constant volume heat exchanger with a combustion heat source.
Figure 8A:
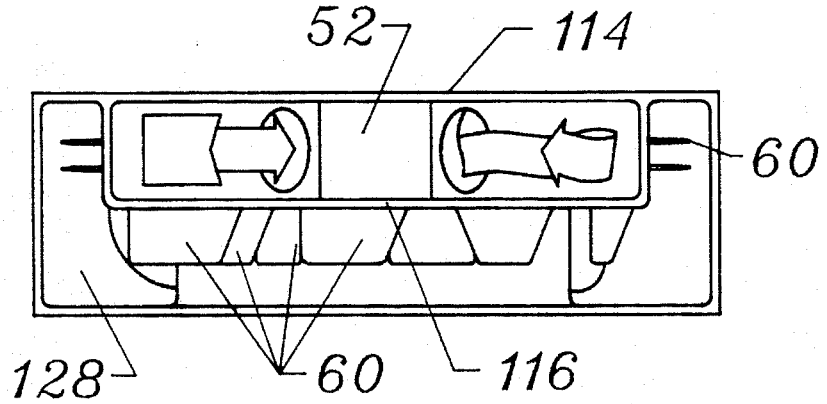
FIG. 8A is a sectional view of FIG. 8 taken through plane A—A.

FIGS. 8 and 8A are respective cross-sectional and sectional views of another embodiment of a regenerative heat exchanger 114 with a combustion heat source 118. An enclosure 116 forms a channel around rotatable and sliding vanes 46 which fit within slots of a slotted rotor 48. The outer edges of sliding vanes 46 slide in close fit within the sidewalls of enclosure 116. An inlet 50 for fluid to be heated is on one side of an inter channel seal 52 and an outlet 54 on the other side of the inter channel seal. The inter channel seal divides cooler upstream from the warmer downstream ends of the channel in which vanes 46 move. The inter channel seal 52 is formed so as to force the radially moving vanes 46 as they travel between heated gas outlet 54 and cooler, unheated gas inlet 50 further into the slots of slotted rotor 48. This acts to minimize leakage of higher pressure gas from outlet 54 into inlet 50.

A combustion chamber 118 is supplied with an air supply system, not shown, an air inlet 120, a fuel supply system, not shown, a fuel inlet line 122, a fuel injector, not shown, an ignitor 124 and an exhaust flue 126. A hot combustion products duct 128 is placed below and around the outer edge of enclosure 116 immediately beneath the path of vanes 46 and in heat transfer contact with the channel formed in enclosure 116. Thermal insulation, not shown, surrounds the exterior surface of combustion product duct 128 and exhaust flue 126 and the upper exterior surface of enclosure 116. Combustion product duct 126 directs hot combustion gases from combustion chamber 118 through duct 128 where its heat is transferred to the gas in the constant volume spaces between rotating vanes 46 in enclosure 116. A drive shaft 130 is connected to and drives slotted rotor 48.

During operation air is supplied through air inlet 120 to combustion chamber 118, which is beneath heated gas outlet 54, where it is preheated in a regenerative manner. Fuel enters combustion chamber 118 through fuel injector 122 which is just downstream of air inlet 120. Ignitor 124 is downstream of fuel injector 122. Fuel is vaporized and ignited within combustion chamber 118. Hot combustion products flow within combustion product duct 128 in a counter flow direction to gas trapped between vanes 46 within enclosure 116 above. Vanes 46 are driven by slotted rotor 48 which in turn is driven by drive shaft 130 and the gas within enclosure 116 is heated between vanes 46. As shown in FIG. 8A, heat transfer is stimulated by fins 60 on the lower surface of enclosure 116 which also forms the upper surface of combustion product duct 128. Combustion products exit through the exhaust flue 126. Slotted rotor 48 and moving partitions 46 are omitted for clarity. Insulation around regenerative heat exchanger 114 and drive shaft 130 have also been omitted from FIG. 8A for clarity.

Gas trapped between moving partitions 46 is regeneratively heated by hot combustion products from combustion chamber 118 that are flowing within combustion products duct 128. As a result, the gases thereby experience pressurization.

Figure 9:
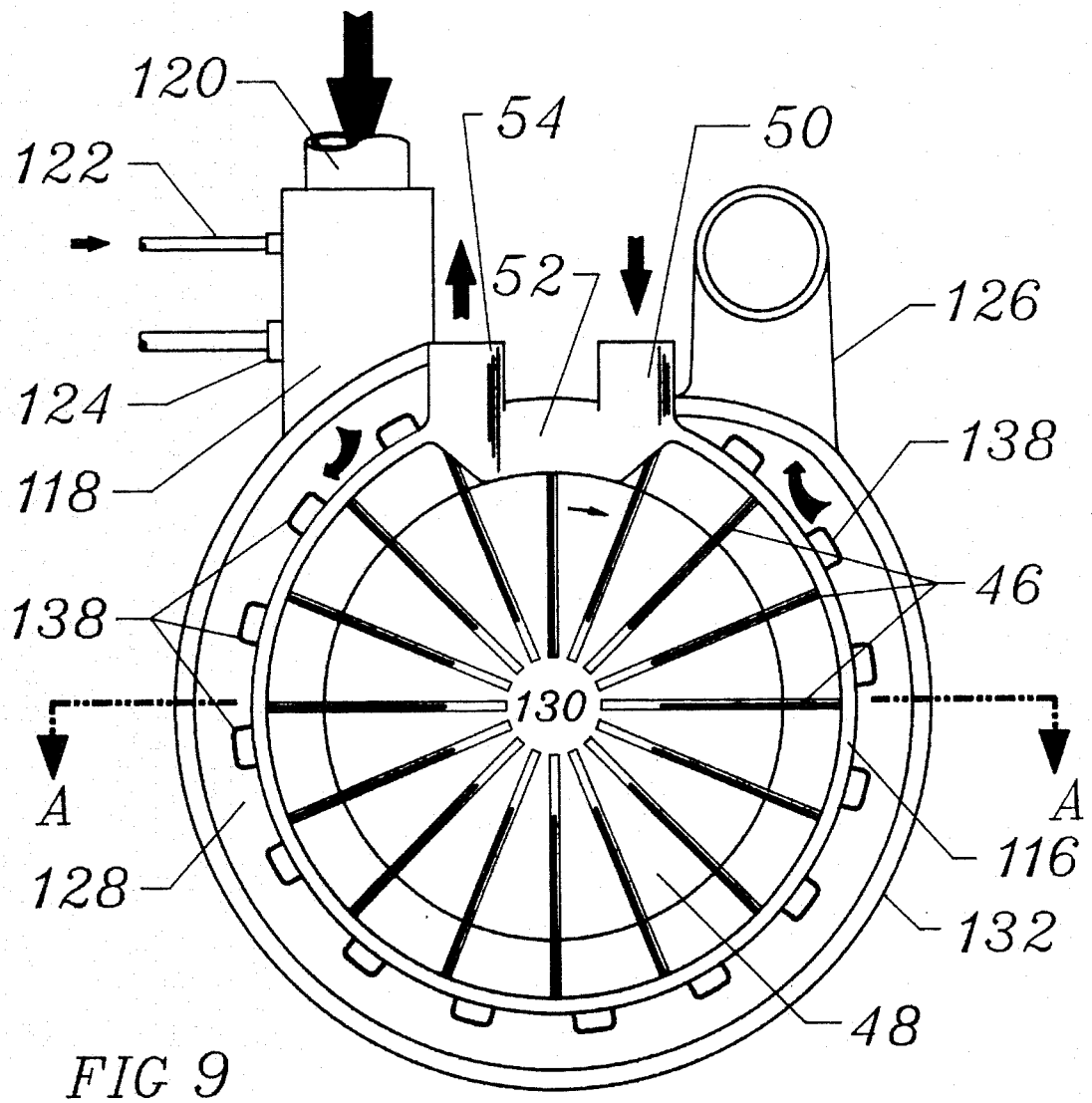
FIG. 9 shows a heat exchanger similar to FIG. 8 with heat pipes between a combustion products duct and an enclosure containing a constant volume rotary vane sub-assembly.
Figure 9A:
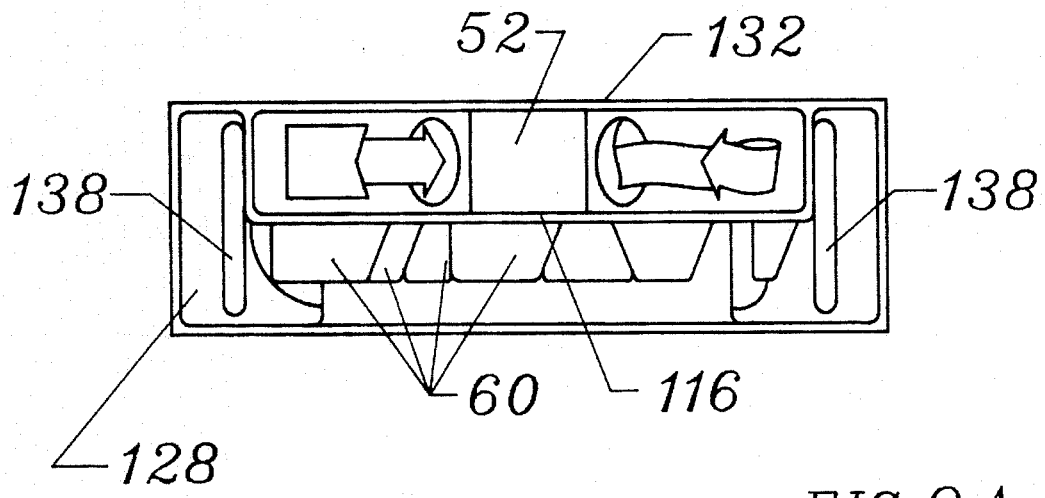
FIG. 9A shows a sectional view of FIG. 9 taken through plane A—A.

FIGS. 9 and 9A are respective cross-sectional and sectional views of another embodiment of a regenerative heat exchanger 132 with a combustion heat source 118. An enclosure 116 forms a channel around rotating and radially sliding vanes 46 which fit within slots of slotted rotor 48. The outer edges of sliding vanes 46 slide in close fit within walls of enclosure 116. There is an inlet 50 for fluid to be heated on one side of an inter channel seal 52 and an outlet 54 for fluid heated within the heat exchanger on the other side of inter channel seal 52. Inter channel seal 52 divides and isolates the cooler upstream end 50 from warmer downstream end 54 of the channel in enclosure 116 which vanes 46 move. Inter channel seal 52 is formed so as to force radially moving vanes 46 while travelling between heated gas outlet 54 and cooler, unheated gas inlet 50 further into the slots of slotted rotor 48. This acts as a seal to minimize leakage of higher pressure gas into the cooler, lower pressure inlet end 50 of the channel contained within enclosure 116.

In almost all respects the embodiment of the invention shown in FIGS. 9 and 9A is similar to that shown in FIGS. 8 and 8A with the exception that heat pipes 138 are provided to enhance thermal coupling between the channel within enclosure 116 and combustion products duct 128. Heat pipes 138 are mounted along the outer surface of enclosure 116 which forms an interior wall for the combustion products duct 128, and extend into the combustion products duct 128. Thermal insulation, not shown, surrounds the exterior surface of combustion products duct 128 and the upper exterior surface of enclosure 116. Combustion products duct 128 connects combustion chamber 118 to exhaust flue 126.

In operation, fuel is vaporized and ignited within combustion chamber 118. Hot combustion products flow within combustion products duct 128 in a counter flow direction to gas trapped between vanes 46 within enclosure 116 juxtaposed above. Vanes 46 are driven by slotted rotor 48 which in turn is driven by drive shaft 130. Inlet gas to be heated is supplied through inlet 50 and is heated at constant volume between vanes 46. Heat transfer is stimulated by fins 60 on the lower surface of enclosure 116 which is also the upper surface of combustion products duct 128. Heat transfer is augmented by heat pipes 138. Combustion products exit through flue 126. The inlet gas trapped between moving partitions 46 is regeneratively heated by hot combustion products from combustion chamber 118 that are flowing within combustion products duct 128. As a result gases thereby experience constant volume regenerative heating with thermal pressurization.

Figure 10:
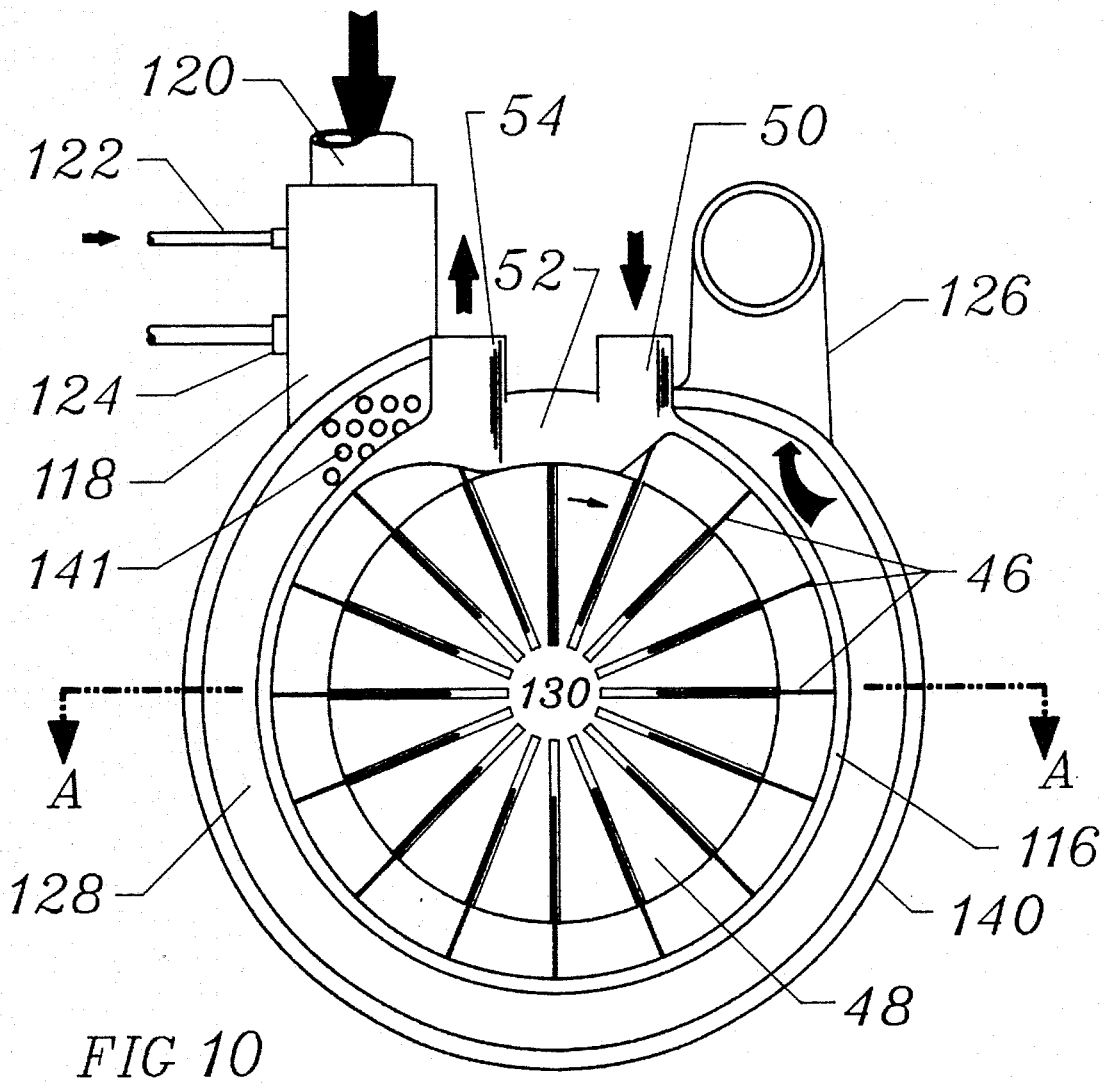
FIG. 10 shows a heat exchanger similar to FIG. 8 with jet impingement.
Figure 10A:
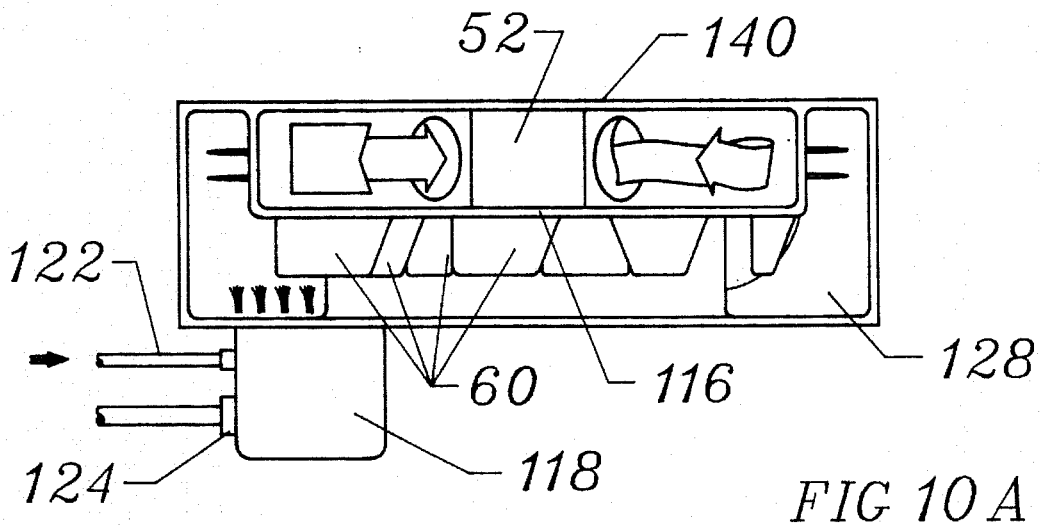
FIG. 10A shows a sectional view taken through plane A—A of FIG. 10.

FIGS. 10 and 10A are respective cross-sectional and sectional views of still another embodiment of a regenerative heat exchanger 140 with a combustion heat source 118. The embodiment shown in FIGS. 10 and 10A is similar in all respects to that of FIGS. 8 and 8A with the exception of the inclusion of the use of jet impingement of the hot products of combustion from combustion chamber 118 into the combustion products duct 128. For the above purposes, combustion chamber 118 is designed with perforations 141 formed in its upper downstream walls which extend into lower, upstream surface of combustion products duct 128. Combustion products duct 128 shares a common wall which contain perforations 141 with enclosure 116 and is placed below and around the outer edge of enclosure 116 and immediately beneath the path of vanes 46. Thermal insulation, not shown, surrounds the exterior surface of combustion products duct 128 and the upper exterior surface of enclosure 116. Combustion chamber 118 is placed immediately over combustion products duct 128 in the vicinity of outlet 54 on the downstream end of enclosure 116.

During operation, fuel is vaporized and ignited within combustion chamber 118. The hot combustion products flow through the perforations 141 between combustion chamber 118 and combustion products duct 128 and also impinges on surface of enclosure 116. The combustion products then flow within combustion products duct 128 in a counter flow direction to gas trapped between vanes 46 within enclosure 116 above. Vanes 46 are driven by slotted rotor 48 which in turn is driven by drive shaft 130. The gas within enclosure 116 being thereby heated in the constant volume space between vanes 46. Heat transfer is stimulated by fins 60 on the lower surface of enclosure 116 which also is the upper surface of combustion products duct 128. Heat transfer is stimulated by jet impingement of hot combustion products upon the lower surface of enclosure 116. Combustion products exit through exhaust flue 126. The gas trapped between rotating vanes 46 is regeneratively heated by hot combustion products from combustion chamber 118 that are flowing within combustion products duct 128. As a result, the inlet gas thereby experiences constant volume regenerative heating with thermal pressurization.

Figure 11:
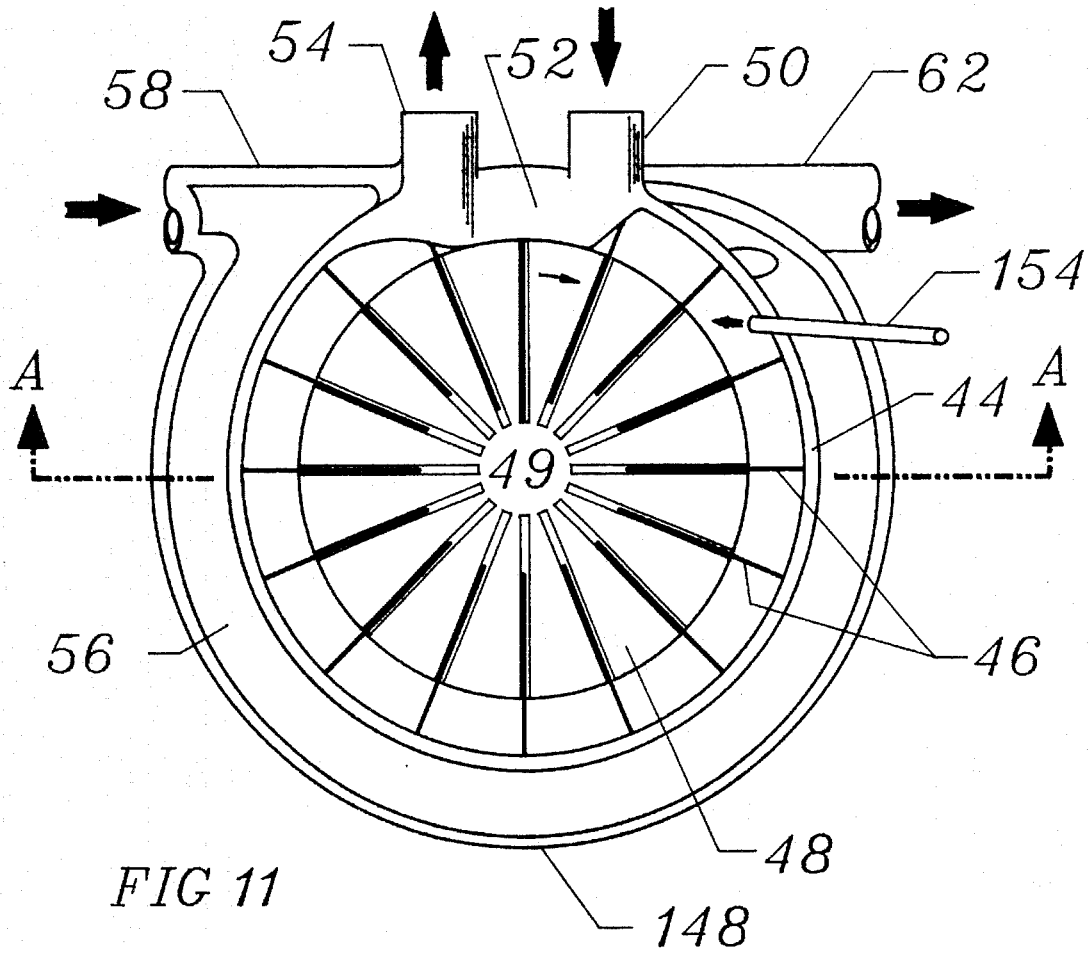
FIG. 11 shows a heat exchanger according to the invention with liquid injection.
Figure 11A:
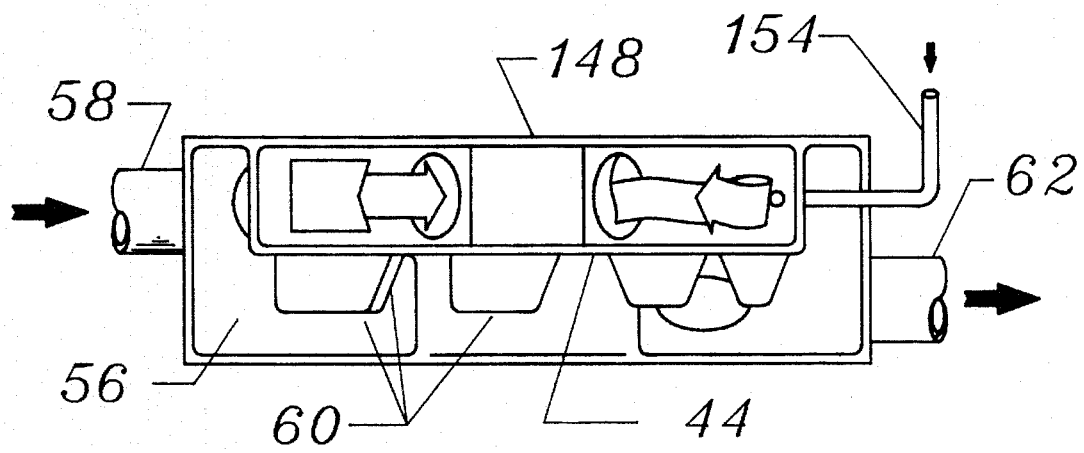
FIG. 11A is a sectional view taken through plane A—A of FIG. 11.
Figure 12:
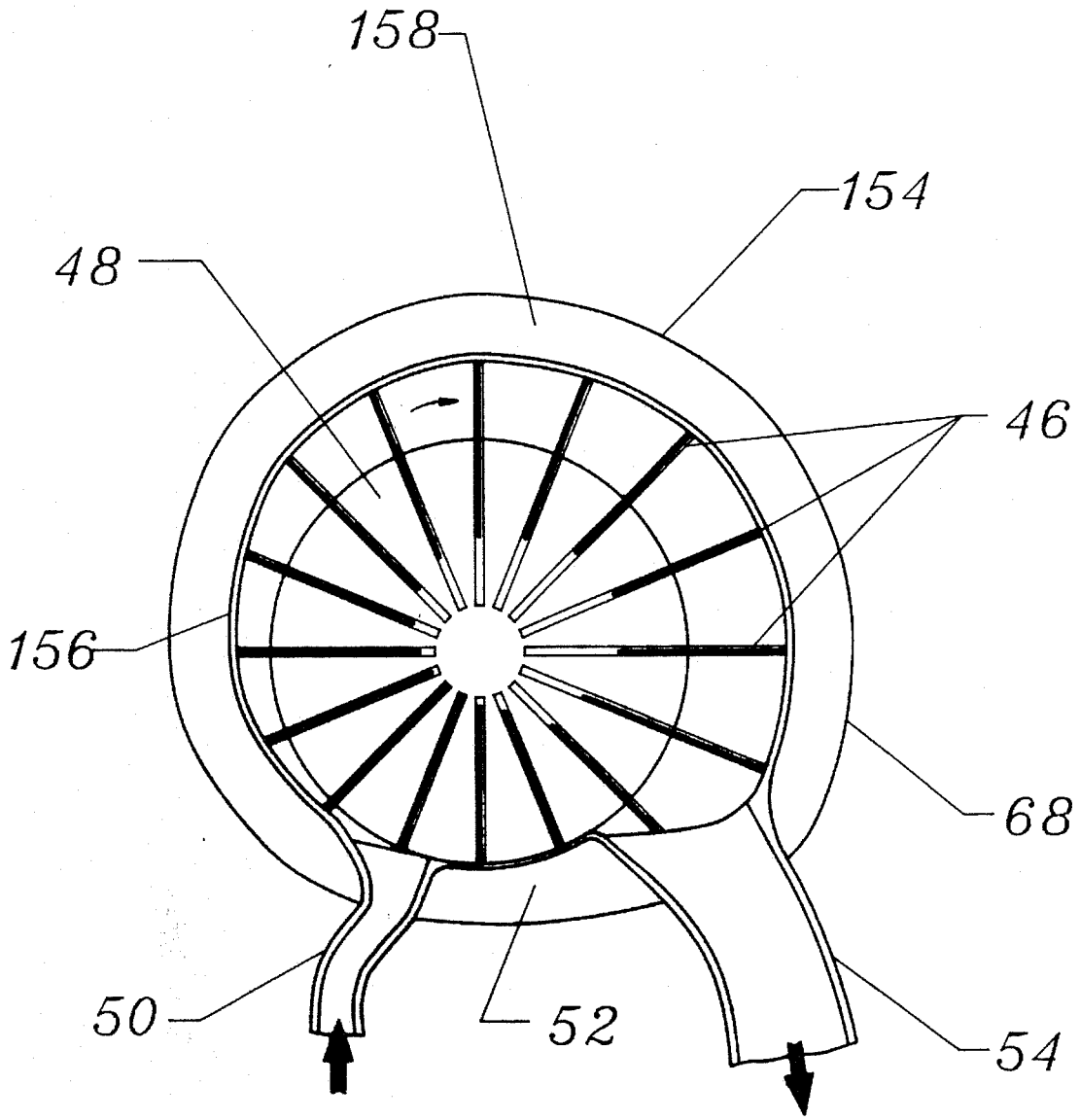

FIGS. 11 and 11A are cross-sectional and sectional views, respectively, of yet another embodiment of a regenerative heat exchanger 148 according to the invention. The embodiment of FIGS. 11 and 11A is in many respects similar to that of FIGS. 4 and 4A but differs therefrom in the addition of a liquid supply for lubrication purposes. In FIG. 11 an enclosure 44 forms a channel around rotatable and radially sliding vanes 46 which fit within slots of slotted rotor 48. The outer peripheral edges of sliding vanes 46 slide in close fit within the sidewalls of enclosure 44. A drive shaft 49 rotatably drives slotted rotor 48. An inlet 50 supplies gas to be heated into enclosure 44 on one side of an inter passage seal 52 and an outlet 54 for the heated gases is provided on the other side of the inter passage seal. Inter passage seal 52 divides the cooler, low pressure upstream end 50 from the warmer high pressure downstream end 54 of the channel in enclosure 44 in which vanes 46 move. Inter passage seal 52 is so formed that it forces rotating and radially moving vane partitions 46 in their travel between higher pressure outlet 54 and cooler, lower pressure inlet 50 to move more deeply into the slots of slotted rotor 48. This forms inter passage seal 52 area and minimizes leakage of higher pressure gas from outlet 54 to lower pressure inlet 50.

A hot fluid channel 56 is supplied with hot fluid through hot fluid inlet 58. Hot .fluid is discharged from outlet 62 at downstream end of hot fluid channel 56 after giving up most of its heat to enclosure 44. A liquid supply line 154 protrudes through enclosure 44 to an orifice in the upstream portion of enclosure 44 for the purpose of lubrication.

During operation gas enters enclosure 44 through inlet 50 and is moved through the channel defined by enclosure 44 in the constant volume spaces between moving vane partitions 46 which are driven by slotted rotor 48 that in turn is driven by drive shaft 49. The gas trapped in the constant volume spaces between moving partitions 46 is heated by hot fluid flowing in hot fluid duct 56. The direction of moving vane partitions 46 and gas trapped in the space between vanes 46 is counter to the flow direction of the hot fluid flowing in hot fluid duct 56. Heat transfer is stimulated by fins 60 on the surface of enclosure 44 which protrude into the hot fluid channel 56. The spent hot fluid in hot fluid channel 56 exits through exhaust outlet 62. Concurrently, liquid is supplied by liquid supply line 154 and is injected into enclosure 44 through an orifice in enclosure 44 and is thrown by centrifugal force around the interior periphery of the enclosure. The liquid when thus introduced acts to reduce friction between moving partitions 46 and walls of enclosure 44. The liquid also acts to reduce leakage of gas past the edges of moving vane partitions 46.

INDUSTRIAL APPLICABILITY

The new and improved heat exchanger made available by the present invention will find application in a number of different heating and cooling systems, such as air conditioning, etc., wherein its ability to reemploy fluids, which normally are considered spent and exhausted to the atmosphere or otherwise disposed of, in a regenerative manner to extract additional heat or cooling effects greatly improves the overall efficiency of such systems.

While there has been described what at present are considered preferred embodiments of this invention, it will be obvious to those skilled in the art that various changes and modifications can be made therein without departing from the spirit of the invention. This invention contemplates any configuration, design, relationship and combination of components which will function in a similar manner and provide an equivalent result which fall within the scope of the appended claims.

What is claimed is:

1. The method of operating a regenerative, constant volume heat exchanger comprising the steps of establishing a first fluid flow to be treated having a given mean operating temperature, the flow of the first fluid being in a first direction at substantially a constant flow rate into a moving constant volume space, said first fluid being a compressible fluid; establishing a counter flow of a second fluid, said second fluid being a compressible fluid, having a different mean operating temperature than that of the first fluid and flowing in a direction substantially opposite the direction of flow of the first fluid; and maintaining the two fluid flow in heat transfer relationship through a substantial part of their flow paths to effect transfer of heat from one of the fluids to the other with an accompanying change in pressure of the first fluid and further including the step of isolating the input of the fluid from its output.

2. The method of operating a regenerative, constant volume heat exchanger according to claim 1 wherein the mean operating temperature of the first fluid is below the mean operating temperature of the second fluid and heating of the first fluid to a higher temperature is achieved.

3. The method of operating a regenerative, constant volume heat exchanger according to claim 1 wherein the mean operating temperature of the first fluid is above the mean operating temperature of the second fluid and cooling of the first fluid to a cooler temperature is achieved.

* * * * *